US005205911A

United States Patent [19]

Kawolics et al.

[11] Patent Number: 5,205,911

[45] Date of Patent: Apr. 27, 1993

[54] CATHODE RESTORATION

[75] Inventors: Richard J. Kawolics; Rudolf C. Matousek, both of Chagrin Falls; Anthony J. Vaccaro, Mentor, all of Ohio

[73] Assignee: OxyTech Systems, Inc., Chardon, Ohio

[21] Appl. No.: 611,581

[22] Filed: Nov. 13, 1990

[51] Int. Cl.[5] ..... C25B 15/00

[52] U.S. Cl. ..... 204/98; 204/128; 204/129; 204/282; 204/292; 204/293; 148/284; 148/287

[58] Field of Search ..... 204/98, 128, 282, 290 R, 204/293, 290 F, 291, 292, 280, 295, 296, 129; 148/284, 287

[56] References Cited

U.S. PATENT DOCUMENTS

| | | | |
|---|---|---|---|
| 4,243,497 | 1/1981 | Nicolas et al. | 204/290 F |
| 4,252,878 | 2/1981 | Lazarz et al. | 429/250 |
| 4,295,951 | 10/1981 | Bommaraju et al. | 204/290 F |
| 4,358,353 | 11/1982 | Rommaraju et al. | 204/98 |
| 4,379,035 | 4/1983 | Chamberlin | 204/98 |
| 4,394,231 | 7/1983 | Nicolas | 204/290 F |
| 4,410,411 | 10/1983 | Fenn, III et al. | 204/283 |
| 4,539,083 | 9/1985 | Samejima et al. | 204/98 |
| 4,720,334 | 1/1988 | Dubois et al. | 204/98 |
| 4,853,101 | 8/1989 | Hruska et al. | 204/296 |

FOREIGN PATENT DOCUMENTS

| | | | |
|---|---|---|---|
| 0023368 | 2/1981 | European Pat. Off. | 204/290 R |
| 0118620 | 9/1980 | Japan | 148/287 |

*Primary Examiner*—John Niebling
*Assistant Examiner*—Kathryn Gorgos
*Attorney, Agent, or Firm*—John J. Freer

[57] ABSTRACT

Chlor-alkali electrolytic cells can have separators used with metal cathodes. These cells may often be subject to frequent current interruptions. Particularly where the cathode and separator exhibit extended life, these interruptions may be numerous. There has now been developed a method for providing successful and desirable cathode operation even for such extended cell life. During cell shutdown, the cathode and separator are subjected to an elevated temperature heat treatment. After heating, and optionally following any rewetting of the diaphragm, the cathode is ready in the cell for continued, rejuvenated performance.

17 Claims, No Drawings

CATHODE RESTORATION

BACKGROUND OF THE INVENTION

In electrolytic cells for the electrolysis of aqueous alkali metal chloride solutions there may be used as cathode, at least as a substrate metal, iron or stainless steel or the like. Such a substrate might contain an active, metallic surface coating. It has, however, been observed that the cathodes can be susceptible to corrosion. It has been found that the use of certain additives will help in retarding this corrosion. Thus, in U.S. Pat, No. 4,379,035, where it is shown to use cathode coatings of porous or activated nickel on a steel substrate, there is taught the addition of small amounts of alkali metal benzoate and alkali metal nitrite to the catholyte compartment of the cell. Such addition can be made directly to the catholyte liquor contained in this compartment. The patent teaches that this addition will retard corrosion of the cathode and, thus, ostensibly aid in extending cathode life.

As discussed in U.S. Pat. No. 4,358,353, cathodes as used in electrolytic cells may be partitioned by a separator such as an asbestos diaphragm or synthetic microporous separator. During operation it can be expected that the cell will be subjected to current interruption. This might be caused simply by routine cell maintenance. According to the teachings in this U.S. Pat. No. 4,358,353, such current interruption can result in the release of sodium hypochlorite in the catholyte which can have an adverse effect on a coating of the metal cathode. It can also be expected that such phenomenon will occur with uncoated cathodes. To improve cathode durability for coated cathodes in view of this, this patent teaches the addition to the catholyte of small amounts of reducing agent which reacts with the sodium hypochlorite to prevent the oxidation, and retard dissolution of the transition metal in the cathode coating. Such patent more particularly details the addition of an alkali metal sulfite or urea.

A similar observation of cathode degradation during cell shutdown, particularly repeated shutdown, is made in U.S. Pat. No. 4,539,083. The solution proposed by this teaching for extending cathode life is also to add a reducing agent to the cathode compartment of the electrolytic cell. The additives proposed by this teaching are agents such as sulfites and phosphites.

As technology improves whereby electrolytic cells are maintained in operation for longer periods of time, current interruptions can become more and more of a factor in degradation of cell components. Additionally, such extended operation for the cells may also create the problem of enhancing the introduction of impurities into cell products. Thus, as cell operations become more extended, it becomes more challenging to provide consistent, high quality product for the life of the cell as well as extended life for all cell components.

SUMMARY OF THE INVENTION

The invention now describes a method for providing a successful and desirable cathode operation even for extended life electrolytic cells. These are cells which because of their extended life, over the full lifetime of the cell, will be subjected to frequent current interruptions. The invention is particularly directed to extended life cathodes wherein a diaphragm, especially an asbestos-substitute, synthetic separator, is present directly on the face of the cathode. Such diaphragm deposited cathodes as are detailed more particularly hereinbelow, may achieve especially desirable, extended life.

During long cell life, these diaphragm coated cathodes over time, especially when operating in contaminated electrolyte or with frequent cell shutdown or other current interruption, or both, can become susceptible to generation of a hydrogen impurity in the chlorine product. The present invention reduces to eliminate such an impurity problem for the extended-life, diaphragm-coated cathodes.

In one aspect, the invention is directed to the method of conditioning a metal cathode, the method being adapted for use with a cathode which has been used in a chlor-alkali cell, and especially wherein a separator is utilized in said cell in conjunction with the cathode, which method comprises heating the cathode at a temperature, and for a time, sufficient to at least substantially effect a change in the characteristic of any oxygen-containing constituent present at the surface of the metal cathode.

In another aspect, the invention is directed to the method of reconditioning a cell, which method is adapted for use with a chlor-alkali cell having a separator in combination with a metal cathode, which method comprises removing the separator and metal cathode combination from the cell, heating the cathode and separator combination for a time and at a temperature sufficient to at least substantially effect a change in the characteristic of any oxygen-containing constituent present on the surface of the metal cathode and separator combination, and returning the separator and cathode combination to the cell.

In yet another aspect, the invention is directed to a metal cathode for use in a chlor-alkali cell, which metal cathode comprises a substrate metal, a surface constituency present on the substrate metal, with the surface constituency including at least one substituent in nonmetallic form, which substituent when in precursor form has elevated electrical conductivity, which precursor can be established on the substrate metal during utilization of the metal cathode in the cell, and which substituent is at least substantially in a form having decreased electrical conductivity of less than $10^2$ ohm-cm.$^{-1}$ at 365° K.

DESCRIPTION OF THE PREFERRED EMBODIMENTS

Typically, the cathode for the electrolytic cell will be an electroconductive metal cathode, e.g., an iron or steel mesh cathode or perforated iron or steel plate cathode. There might be an active surface layer on the cathode, e.g., of nickel, molybdenum, or an oxide thereof which might be present together with cadmium. Other metal-based cathode layers can be provided by alloys such as nickel-molybdenum-vanadium and nickel-molybdenum. Such activated cathodes are well known and fully described in the art. Other metal cathodes can be in intermetallic mixture or alloy form, such as iron-nickel alloy, stainless steel or alloys with cobalt, chromium or molybdenum, or the metal of the cathode may essentially comprise nickel, cobalt, molybdenum, vanadium or manganese.

For the separator in the cell, also referred to herein as the cell diaphragm, asbestos is a well-known and useful material for making a separator. Additionally, synthetic microporous separators can be utilized. The diaphragm can be deposited directly on the cathode as disclosed for example in U.S. Pat. No. 4,410,411. Such a deposited diaphragm as therein disclosed can be prepared from asbestos plus a halocarbon binding agent. Of particular interest for the diaphragm, there is the generally non-asbestos, synthetic fiber separator containing inorganic particulates as disclosed in U.S. Pat. No. 4,853,101. The teachings of this patent are incorporated herein by reference.

Usually during cell shutdown, the cathode or diaphragm coated cathode, i.e., the cathode unit, can undergo routine maintenance. This may be preceded by removal of the cathode or cathode unit from the cell. It is acceptable to remove the cathode or cathode unit from the cell for conditioning in accordance with the present invention. Whether or not the cathode or cathode unit is removed from the cell, this conditioning will include heating. The cathode, or diaphragm coated cathode unit is maintained at a temperature, and for a heating time, sufficient to substantially effect a change in the characteristic of any oxygen-containing constituent present at the surface of the metal cathode, or present in or on the diaphragm.

Referring as representative to iron or steel as a substrate metal for the cathode, cell operation, as during shutdown, or shutdown and subsequent restart, may lead to iron corrosion products on the cathode, which can result in the formation of magnetite ($Fe_3O_4$) at this cathode surface. Such a cathode has been found to be associated with the deleterious generation of hydrogen in the chlorine product for a chlor-alkali cell. Also, with contaminated electrolyte, cell operation even without shutdown may lead to the eventual presence of magnetite at the cathode surface. This can be the case when deleterious quantities of iron contamination are present in the electrolyte. It is to be understood that a combination of electrolyte contamination as well as iron corrosion may contribute to the problem.

Continuing then with this representative iron cathode which now contains surface magnetite, the heating should be at a temperature and for a time sufficient to at least substantially convert this allotropic form to a different form at the surface of the metal cathode. For efficiency and economy of conversion for this representative cathode, the heating will convert the magnetite to hematite ($Fe_2O_3$). This can be accomplished by heating at a modest temperature, e.g., at a temperature usually above about 230° C., and more typically above about 250° C. up to about 300° C. The heating time can extend for at least about 2 hours up to several days, e.g., 2 to 3 days. Such a heating time and temperature is particularly advantageous where the resulting cathode restoration is for a diaphragm coated cathode unit. For example, with the preferred separator made from synthetic fibers which have inorganic particulates firmly bound therewith, such temperature and time will not have any substantially deleterious effect on the separator present on the cathode.

Desirably, for the representative conversion of magnetite to hematite, and particularly where the magnetite is in contact with, or has at least some particles at least slightly embedded in, the diaphragm, there results the change from an oxide constituent at the surface of the cathode having an electroconductivity greater than about $10^2$ ohm-cm.$^{-1}$ at 365° K. to a constituent having a conductivity of about $10^{-16}$ ohm-cm.$^{-1}$ also at 365° K. That is, there results a change from an oxide constituent which has an electrical conductivity that is elevated in comparison to the electrical conductivity of the constituent resulting from the change. It is to be understood this may not be an electrical conductivity which is elevated in comparison to the substrate metal, and such is to be understood in the discussions of electrical conductivity herein. Referring again to the representative comparison, because of the ability of a non-conditioned iron cathode to generate deleterious quantities of hydrogen, where the cathode is used in a chlor-alkali cell utilized for the production of chlorine and caustic, any surface constituency on the cathode should have an electroconductivity of less than $10^2$ (ohm-cm.)$^{-1}$ at 365° K. Advantageously, such constituent electroconductivity will be less than about 10 ohm-cm.$^{-1}$, and preferably less than $10^{-6}$ ohm-cm.$^{-1}$, both at 365° K.

Usually for effecting the cathode restoration of the present invention the cell will be jumpered, taken out of service for routine maintenance, and thereby drained of electrolyte. The cathode, more typically a diaphragm coated cathode, may be removed from the cell. For restoration, the cathode or coated cathode unit, can be placed in an oven. In the oven the cathode or cathode unit will be treated under the conditions as described hereinbefore, with care being taken to conduct the heating in an oxygen-containing atmosphere, e.g., air for economy.

Following the heating, and subsequent cooling, the cathode or the like is removed from the oven and can be reinstalled in the cell. Particularly with the preferred synthetic separator as described hereinbefore, it is advisable to have the separator portion of the coated cathode unit subjected to a wetting operation, either before installation in the cell or after installation but before cell startup. A suitable such treatment has been disclosed for example in U.S. Pat. No. 4,252,878.

The following example shows a way in which the invention has been practiced but should not be construed as limiting the invention.

EXAMPLE

A slurry was mixed containing polytetrafluoro-ethylene fibers which were impacted with particulate zirconia, all in accordance with the teachings in U.S. Pat. No. 4,853,101. Test cathodes comprised a 5¾ inch square wire mesh sheet of carbon steel wires. The cathodes were provided with a diaphragm from the slurry in the manner described in the above-noted patent. The diaphragm coated cathodes were assembled in cell bodies of laboratory bench cells using narrow gap configuration opposite from a dimensionally stable anode. For the cells, the start-up procedure was such that the diaphragm on each cathode was wetted with a halohydrocarbon surfactant, Zonyl® FSN from E. I. DuPont, in the manner as described in U.S. Pat. No. 4,252,878, Example 1. After the introduction of brine to each cell, the cell was heated to 93° C., and then had electric current of 25 amperes applied. Two cells were subjected to electrical outages. Hydrogen ($H_2$) in the chlorine product for these two cells was measured by Orsat analysis. This hydrogen measurement for each cell was conducted at cell startup and during cell operation after two outages and is reported in the table below.

These two cells, each showing very high levels of hydrogen, were disassembled on the third power outage, and the cathode-diaphragm assembly for each cell was baked at 290° C. for 6 hours. This temperature is low enough so that no further fusion of the diaphragm takes place. Examination of the diaphragms before and after the treatment, made by visual microscopy, showed that the surface black spots of magnetite on the carbon steel wire cathodes were replaced by the red color of hematite. These cells were then rewetted with the surfactant and reinstalled. Cell operation was reinstituted in the manner as described above. During operation, hydrogen evolution measurement was again undertaken. The operating hydrogen evolution thus measured is shown in the table below.

TABLE

| | PERCENT $H_2$ IN CHLORINE PRODUCT | | |
|---|---|---|---|
| Cell | At Start | Aft. 2 Outages | Aft. Treatment |
| One | 0.0 | 3.0 | 0.0 |
| Two | 0.0 | 4.0 | 0.0 |

What is claimed is:

1. The method of conditioning a metal cathode which has been used in a chlor-alkali cell, and especially wherein a separator is utilized in said cell in conjunction with said cathode and said cell is susceptible to the generation of hydrogen impurity in chlorine product, which method comprises heating said cathode in an oxygen-containing atmosphere at a temperature, and for a time, sufficient to at least substantially effect a change in the form of any oxygen-containing constituent present at the surface of said metal cathode.

2. The method of claim 1, wherein said heating is at a temperature, and for a time, sufficient to at least substantially change the allotropic form of any oxide present at the surface of said metal cathode.

3. The method of claim 2, wherein said oxide comprises an autogenous oxide of the cathode metal.

4. The method of claim 2, wherein said oxide comprises a deposited oxide on the cathode metal.

5. The method of claim 2, wherein said cathode metal is steel and said oxygen-containing constituent comprises magnetite, which is at least substantially converted to hematite during said heating.

6. The method of claim 5, wherein said magnetite is at least in contact with said separator and on heating is at least substantially converted to hematite.

7. The method of claim 6, wherein said magnetite contacts and is at least partially embedded in said separator.

8. The method of claim 1, wherein said heating converts an oxide constituent having an electrical conductivity of greater than about $10^2$ ohm-cm.$^{-1}$ at 365° K. to a constituent of lesser conductivity.

9. The method of claim 8, where said conversion is to a constituent of electrical conductivity of less than 10 ohm-cm.$^{-1}$ at 365° K.

10. The method of claim 1, wherein said heating is conducted outside the cell at a temperature above about 230° C. for a time of at least about 2 hours.

11. The method of claim 1, wherein said heating is conducted at a temperature and for a time sufficient to not substantially deleteriously effect said separator present with said metal cathode.

12. The method of claim 11, wherein said separator is a synthetic porous separator and the cathode and separator are subsequently installed in an electrolytic cell.

13. The method of claim 12, wherein said synthetic porous separator is treated with halocarbon surfactant following heating.

14. The method of claim 1, wherein said heating follows treating of a synthetic porous separator with halocarbon and said heating dries said separator.

15. In the method of reconditioning a chlor-alkali cell having a separator in combination with a metal cathode and said cell is susceptible to the generation of hydrogen impurity in chlorine product, which method comprises removing said separator and metal cathode combination from said cell, heating said cathode and separator combination in an oxygen-containing atmosphere for a time and at a temperature sufficient to at least substantially effect a change in the form of any oxygen-containing constituent present on the surface of said metal cathode and separator combination, but insufficient to substantially deleteriously effect said separator, and returning said separator and cathode combination to said cell.

16. The method of claim 15, wherein said cell is shut down and drained of electrolyte prior to removal of said separator and cathode.

17. The method of claim 15, wherein said separator after heating is treated with halocarbon and dried and subsequently returned to said cell.

* * * * *